US008972038B2

(12) United States Patent
Ihira et al.

(10) Patent No.: US 8,972,038 B2
(45) Date of Patent: Mar. 3, 2015

(54) INFORMATION PROCESSING DEVICE, SEWING MACHINE AND NON-TRANSITORY RECORDING MEDIUM STORING PROGRAM

(71) Applicants: Yuki Ihira, Kakamigahara (JP); Daisuke Abe, Nagoya (JP); Akie Shimizu, Nagoya (JP); Satoru Makino, Nagoya (JP); Satoru Ichiyanagi, Nagoya (JP); Yoshio Nishimura, Nagoya (JP); Yutaka Nomura, Anjo (JP); Yoshinori Nakamura, Toyohashi (JP)

(72) Inventors: Yuki Ihira, Kakamigahara (JP); Daisuke Abe, Nagoya (JP); Akie Shimizu, Nagoya (JP); Satoru Makino, Nagoya (JP); Satoru Ichiyanagi, Nagoya (JP); Yoshio Nishimura, Nagoya (JP); Yutaka Nomura, Anjo (JP); Yoshinori Nakamura, Toyohashi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 148 days.

(21) Appl. No.: 13/792,675

(22) Filed: Mar. 11, 2013

(65) Prior Publication Data

US 2013/0239858 A1 Sep. 19, 2013

(30) Foreign Application Priority Data

Mar. 14, 2012 (JP) ..... 2012-057274

(51) Int. Cl.
*D05B 19/10* (2006.01)
*D05C 5/06* (2006.01)

(52) U.S. Cl.
CPC . *D05B 19/10* (2013.01); *D05C 5/06* (2013.01)
USPC ..... 700/135; 700/138

(58) Field of Classification Search
USPC ..... 700/136–138, 135
See application file for complete search history.

(56) References Cited

U.S. PATENT DOCUMENTS

| | | | | |
|---|---|---|---|---|
| 4,718,017 | A * | 1/1988 | Hutton et al. | 700/133 |
| 5,211,120 | A * | 5/1993 | de Oliveira | 112/470.02 |
| 5,343,401 | A * | 8/1994 | Goldberg et al. | 700/138 |
| 5,506,784 | A * | 4/1996 | Tsonis et al. | 700/138 |
| 5,510,994 | A * | 4/1996 | Tsonis et al. | 700/137 |
| 5,668,730 | A * | 9/1997 | Tsonis et al. | 700/138 |
| 6,324,441 | B1 * | 11/2001 | Yamada | 700/138 |
| 7,789,029 | B2 * | 9/2010 | Tashiro | 112/470.01 |
| 7,814,851 | B2 * | 10/2010 | Tashiro | 112/470.01 |
| 8,155,776 | B2 * | 4/2012 | Bittner et al. | 700/131 |
| 8,644,976 | B2 * | 2/2014 | Bittner et al. | 700/131 |
| 8,682,467 | B2 * | 3/2014 | Ihira et al. | 700/138 |
| 8,694,147 | B2 * | 4/2014 | Okuyama | 700/138 |
| 8,731,705 | B2 * | 5/2014 | Maki | 700/138 |
| 8,774,957 | B2 * | 7/2014 | Maki et al. | 700/138 |
| 8,793,009 | B2 * | 7/2014 | Ihira | 700/138 |
| 8,818,546 | B2 * | 8/2014 | Kato | 700/138 |
| 2008/0196645 | A1 * | 8/2008 | Ikeba et al. | 112/470.01 |
| 2011/0107950 | A1 | 5/2011 | Takahata et al. | |
| 2012/0265332 | A1 * | 10/2012 | Laidig | 700/104 |
| 2014/0069308 | A1 * | 3/2014 | Tokura | 112/102.5 |

FOREIGN PATENT DOCUMENTS

JP A-2011-101695 5/2011

* cited by examiner

*Primary Examiner* — Danny Worrell
(74) *Attorney, Agent, or Firm* — Oliff PLC

(57) ABSTRACT

An information processing device includes a processor and a memory. The memory is configured to store computer-readable instructions. The instructions instruct the information processing device to execute steps including randomly arranging a plurality of embroidery patterns within a coordinate area set in an embroidery frame that is moved in two directions.

12 Claims, 11 Drawing Sheets

INFORMATION PROCESSING DEVICE, SEWING MACHINE AND NON-TRANSITORY RECORDING MEDIUM STORING PROGRAM

CROSS-REFERENCE TO RELATED APPLICATION

This application claims priority from Japanese Patent Application No. 2012-057274, filed on Mar. 14, 2012, the content of which is hereby incorporated by reference.

BACKGROUND

The present disclosure relates to an information processing device, a sewing machine and a non-transitory recording medium storing a program.

Conventionally, a sewing machine is known that decides a method for arranging unit patterns in accordance with a user input and performs sewing of an embroidery pattern. For example, an embroidery data processing device is disclosed that can arrange unit patterns in a layout desired by a user and generate a variety of embroidery data. The embroidery data processing device sets at least three reference points to decide arrangement positions of the unit patterns. The embroidery data processing device sets reference lines. The reference lines are two straight lines intersecting with each other, and each of the reference lines passes through at least two of the plurality of reference points. Based on a distance between the reference points through which the reference line passes, the embroidery data processing device sets a matrix reference plane that is used as a reference when arranging each of the unit patterns, and determines an arrangement position of each of the unit patterns based on the reference plane. When the unit pattern to be arranged in the arrangement position is selected, the embroidery data processing device arranges the selected unit pattern in the arrangement position and generates embroidery data.

SUMMARY

There are cases in which, for example, the user wants to generate embroidery data such that a plurality of same embroidery patterns are randomly arranged. The above-described embroidery data processing device arranges the unit patterns in a layout desired by the user, as described above. Therefore, the user needs to copy the unit patterns one by one and to randomly move and arrange them. As a result, a great deal of time and effort are required to generate the embroidery data.

The present disclosure provides an information processing device, a sewing machine and a non-transitory recording medium storing a program that can randomly arrange a plurality of embroidery patterns and easily generate a variety of embroidery data.

An information processing device according to a first aspect of the present disclosure includes a processor and a memory. The memory is configured to store computer-readable instructions that instruct the information processing device to execute steps including randomly arranging a plurality of embroidery patterns within a coordinate area set in an embroidery frame that is moved in two directions.

A sewing machine according to a second aspect of the present disclosure includes a sewing device, an embroidery frame, a processor, and a memory. The sewing device is configured to perform sewing of an embroidery pattern on a work cloth. The embroidery frame is configured to hold the work cloth, and to be moved in two directions. The memory is configured to store computer-readable instructions that instruct the sewing machine to execute steps including randomly arranging a plurality of embroidery patterns within a coordinate area set in the embroidery frame.

A non-transitory computer-readable medium according to a third aspect of the present disclosure stores computer-readable instructions that instruct an information processing device. The computer-readable instructions instruct the information processing device to execute steps including randomly arranging a plurality of embroidery patterns within a coordinate area set in an embroidery frame that is moved in two directions.

BRIEF DESCRIPTION OF THE DRAWINGS

Embodiments of the invention will be described below in detail with reference to the accompanying drawings in which.

DETAILED DESCRIPTION OF THE EXEMPLARY EMBODIMENTS

Figure 1:
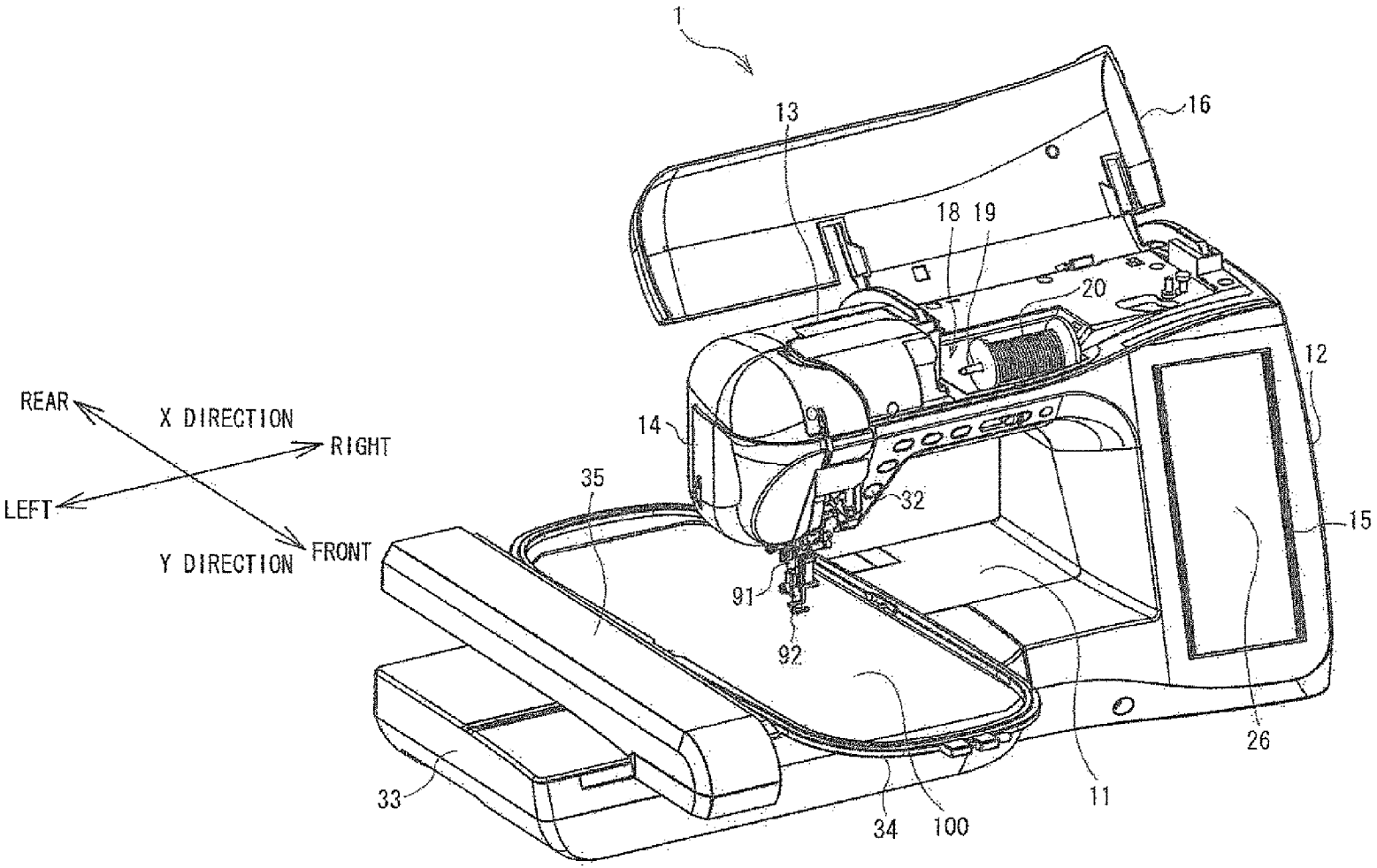
FIG. 1 is a perspective view of a sewing machine 1 as viewed from the front left side.

Hereinafter, an embodiment of the present disclosure will be explained with reference to the drawings. The drawings are used to explain technical features that can be adopted by the present disclosure, and the drawings are not intended to limit the content. Device configurations, flowcharts of various processing and the like shown in the drawings are merely explanatory examples.

A physical configuration of the sewing machine 1 will be explained with reference to FIG. 1. In the explanation below, the upper side, the lower side, the lower right side, the upper left side, the upper right side and the lower left side of FIG. 1 respectively correspond to the upper side, the lower side, the front side, the back side, the right side and the left side of the sewing machine 1. As shown in FIG. 1, the sewing machine 1 is provided with a bed portion 11, a pillar 12, an arm portion 13 and a head portion 14. The bed portion 11 is a base portion of the sewing machine 1 and extends in the left-right direction. The pillar 12 extends upward from the right end of the bed portion 11. The arm portion 13 extends to the left from the upper end of the pillar 12 such that the arm portion 13 faces the bed portion 11. The head portion 14 is a portion that is connected to the left end of the arm portion 13. A needle plate (not shown in the drawings) is disposed on a top surface of the bed portion 11. A feed dog, a feed mechanism, a shuttle mechanism (which are not shown in the drawings) and a feed adjustment pulse motor 78 (refer to FIG. 2) are provided below the needle plate (namely, inside the bed portion 11). The feed dog is driven by the feed mechanism, and moves a work cloth 100 by a predetermined feed amount. The feed amount of the feed dog is adjusted by the feed adjustment pulse motor 78.

An embroidery frame 34 that holds the work cloth 100 can be disposed above the bed portion 11. The embroidery frame 34 has a known structure that holds the work cloth 100 by clamping it between an inner frame and an outer frame. An embroidery frame transport device 33 that moves the embroidery frame 34 has a known structure, so it will be explained briefly. The embroidery frame transport device 33 can be mounted on and removed from the bed portion 11. A carriage 35 that extends in the front-rear direction is provided on an upper portion of the embroidery frame transport device 33. A frame holder (not shown in the drawings) on which the embroidery frame 34 can be removably mounted and a Y axis transport mechanism (not shown in the drawings) that moves the frame holder in the front-rear direction (the Y direction) are provided in the interior of the carriage 35. The Y axis transport mechanism is driven by a Y axis motor 84 (refer to FIG. 2).

An X axis transport mechanism (not shown in the drawings) that moves the carriage 35 in the left-right direction (the X direction) is provided within the main body of the embroidery frame transport device 33. The X axis transport mechanism is driven by an X axis motor 83 (refer to FIG. 2). The embroidery frame 34 is moved in the left-right direction (the X direction) as the carriage 35 is moved in the left-right direction (the X direction).

A needle bar (not shown in the drawings) and the shuttle mechanism (not shown in the drawings) are driven in conjunction with the moving of the embroidery frame 34 in the left-right direction (the X direction) and the front-rear direction (the Y direction). The driving of the needle bar and the shuttle mechanism causes a sewing needle (not shown in the drawings) that is mounted on the needle bar to sew an embroidery pattern on the work cloth 100 that is held by the embroidery frame 34. In a case where a normal practical pattern that is not an embroidery pattern is sewn, the sewing is performed as the work cloth is moved by the feed dog, in a state in which the embroidery frame transport device 33 has been removed from the bed portion 11.

A liquid crystal display (LCD) 15 having a vertically long rectangular shape is provided on the front face of the pillar 12. The LCD 15 displays an image that includes various types of items, such as commands, illustrations, set values, messages and the like. A touch panel 26 is provided on the front face of the LCD 15. When a user performs an operation of pressing the touch panel 26 using a finger or a special touch pen, the item that corresponds to the pressed position that is detected by the touch panel 26 is recognized as being selected. Hereinafter, the above-described pressing operation is called a "panel operation". With the above-described panel operation, the user can select the pattern to be sewn and a command to be executed.

The arm portion 13 is provided on its upper portion with a cover 16 that can be opened and closed. Underneath the cover 16, that is, roughly in the central portion within the arm portion 13, a thread containing portion 18 is provided that is a recessed portion in which a thread spool 20 can be accommodated. A thread spool pin 19 that projects leftward toward the head portion 14 is provided on an inner wall surface on the pillar 12 side of the thread containing portion 18. The thread spool 20 has an insertion hole (not shown in the drawings). The thread spool 20 is mounted in the thread containing portion 18 in a state in which the thread spool pin 19 has been inserted into the insertion hole.

An upper thread (not shown in the drawings) that is wound around the thread spool 20 is supplied from the thread spool 20, through a thread hook (not shown in the drawings) that is provided on the head portion 14, to the sewing needle mounted on the needle bar. The needle bar is driven such that it moves up and down by a needle bar up-and-down moving mechanism (not shown in the drawings) that is provided in the head portion 14. The needle bar up-and-down moving mechanism is driven by a drive shaft (not shown in the drawings) that is rotationally driven by a sewing machine motor 79 (refer to FIG. 3). A presser bar 91 extends downward from the lower end of the head portion 14. A presser foot 92 that holds the work cloth 100 in place is replaceably mounted on the presser bar 91. A plurality of operation switches that include a start-and-stop switch 32 are provided on the lower part of the front face of the arm portion 13.

Further, a power supply switch 31 (refer to FIG. 2) and a card slot 17 (refer to FIG. 2) are also provided in the right side surface of the pillar 12. The power supply switch 31 turns the power supply of the sewing machine 1 on and off. The card slot 17 can be connected to a memory card that is a storage medium.

Figure 2:
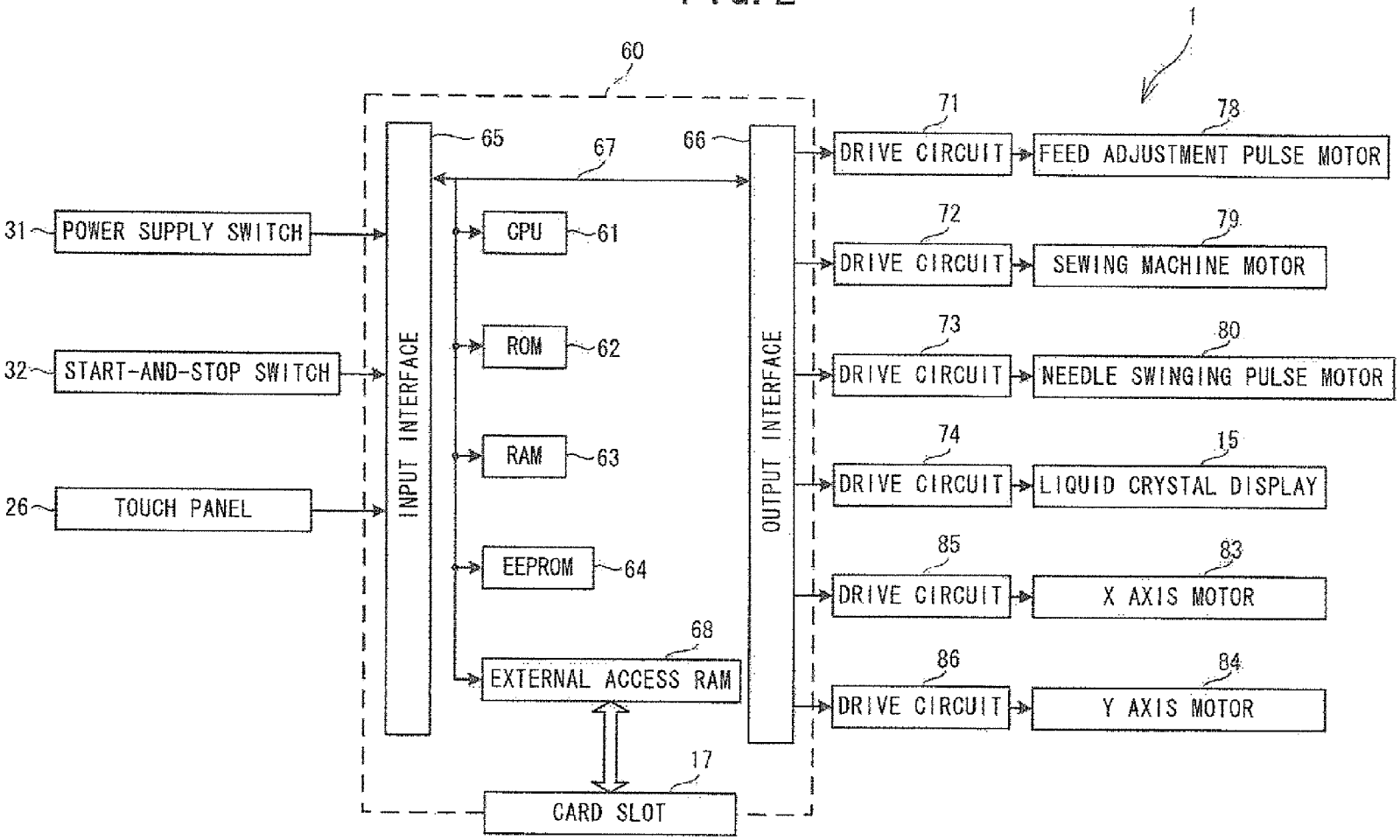
FIG. 2 is a block diagram showing an electrical configuration of the sewing machine 1.

An electrical configuration of the sewing machine 1 will be explained with reference to FIG. 2. A control portion 60 of the sewing machine 1 includes a CPU 61, a ROM 62, a RAM 63, an EEPROM (registered trademark) 64, an external access RAM 68, the card slot 17, an input interface 65 and an output interface 66, which are electrically connected to one another via a bus 67. The input interface 65 is electrically connected to the touch panel 26 and the plurality of operation switches including the power supply switch 31 and the start-and-stop switch 32 and the like.

Drive circuits 71 to 74, 85 and 86 are electrically connected to the output interface 66. The drive circuit 71 drives the feed adjustment pulse motor 78. The drive circuit 72 drives the sewing machine motor 79. The drive circuit 73 drives a needle swinging pulse motor 80 that drives a needle bar swinging mechanism (not shown in the drawings) that swings the needle bar. Note, however, that the feed adjustment pulse motor 78 and the needle swinging pulse motor 80 are not driven when an embroidery pattern is sewn. The drive circuit 74 drives the LCD 15. The drive circuits 85 and 86 respectively drive the X axis motor 83 and the Y axis motor 84 for moving the embroidery frame 34.

The ROM 62 stores various types of programs for controlling the operation of the sewing machine 1. The CPU 61 performs various types of computations and processing in accordance with the programs that are stored in the ROM 62, while temporarily storing various types of data in the RAM 63. Pattern IDs and pattern data for various practical patterns and embroidery patterns that can be sewn by the sewing machine 1 are stored in association with each other in the EEPROM 64. The pattern IDs are unique identification codes to identify each of the individual patterns. Hereinafter, the pattern data of an embroidery pattern is referred to as embroidery data. The embroidery data includes coordinate data that indicates needle drop points, which are positions where the sewing needle pierces the work cloth 100, thread color data, mask data, and data indicating a reference point. The mask data is data that indicates the smallest rectangle that contains an embroidery pattern. The reference point is a point that indicates the center position of the embroidery pattern, and is set at an intersection point of diagonal lines of the rectangular shape indicated by the mask data.

Figure 3:
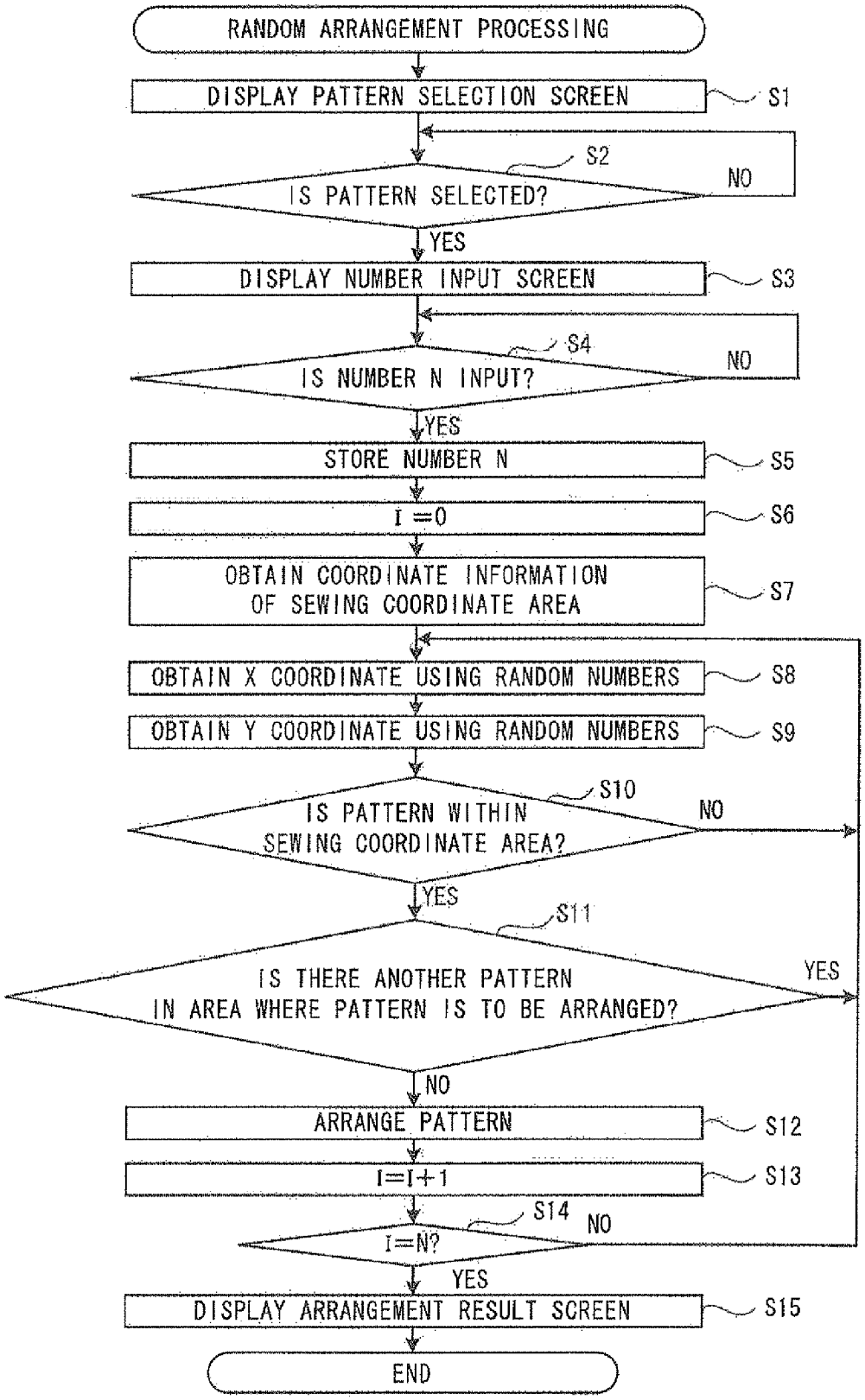
FIG. 3 is a flowchart of random arrangement processing.

Random arrangement processing that is performed by the CPU 61 will be explained with reference to FIG. 3. For example, when the power supply of the sewing machine 1 is turned on, a menu screen (not shown in the drawings) is displayed on the LCD 15, for example. The user selects, for example, a random arrangement function from the menu screen. When the random arrangement function is selected from the menu screen, the CPU 61 activates a program for the random arrangement processing that is stored in the ROM 62, for example, and starts this processing.

Figure 4:
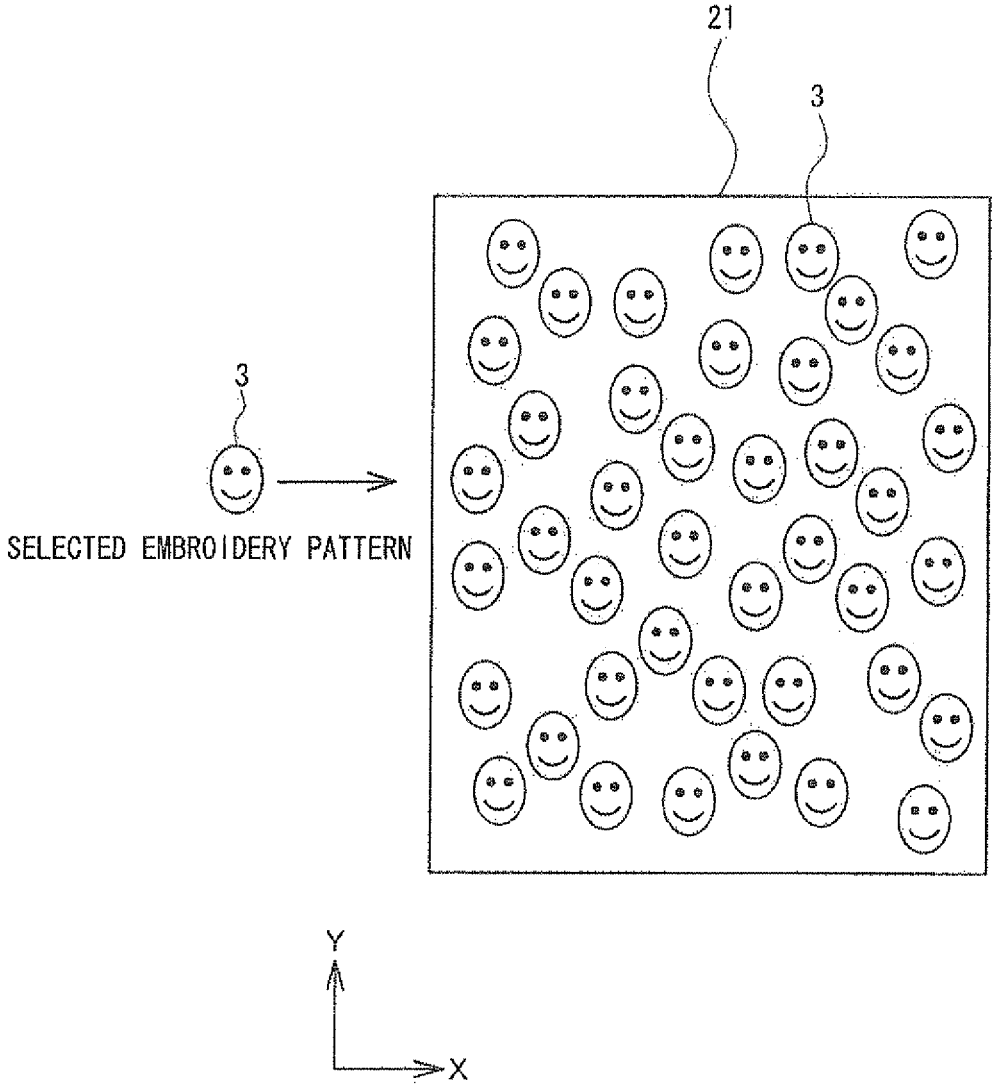
FIG. 4 is a diagram showing a state in which embroidery patterns 3 are randomly arranged within a sewing coordinate area 21.

First, the CPU 61 displays a pattern selection screen (not shown in the drawings) on the LCD 15 (step S1). The CPU 61 determines whether a pattern is selected (step S2). Until one of the patterns is selected from the displayed pattern selection screen (no at step S2), the CPU 61 returns the processing to step S2 and is in a standby state. Note that, in the present embodiment, a case is assumed in which, for example, an embroidery pattern 3 shown in FIG. 4 is selected. The embroidery pattern 3 represents a face, for example.

For example, in a case where the embroidery pattern 3 is selected by the user (yes at step S2), the CPU 61 displays a number input screen (not shown in the drawings) on the LCD 15 (step S3). The number of the embroidery patterns 3 that are randomly arranged is set to be N, for example. The number input screen is a screen that is used to input the number N. The CPU 61 determines whether the number N is input (step S4). Until the number N is input (no at step S4), the CPU 61 returns the processing to step S4 and is in a standby state. In a case where the number N is input by the user (yes at step S4), the CPU 61 stores the input number N in the RAM 63, for example (step S5).

Next, the CPU 61 initializes a counter value I to 0 (step S6). The counter value I is counted by a pattern arrangement counter, for example. The pattern arrangement counter counts the number of the embroidery patterns 3 arranged within a sewing coordinate area 21 (refer to FIG. 4), for example, in processing that will be described later. The counter value I is stored in the RAM 63, for example.

Further, the CPU 61 obtains coordinate information of the sewing coordinate area 21 (step S7). For example, the sewing coordinate area 21 is a coordinate area that corresponds to an area of the embroidery frame 34, and the sewing is able to be performed on the area. The coordinate information includes, for example, information of coordinate values in the X axis direction and the Y axis direction. The X axis and the Y axis are two axes that are orthogonal to each other.

The coordinate information includes, for example, information of coordinate values in the X axis direction and the Y axis direction. The X axis and the Y axis are two axes that are orthogonal to each other.

The CPU 61 obtains an X coordinate where the embroidery pattern 3 is to be arranged, using a random number from a range of the X axis of the sewing coordinate area 21 (step S8). There are various methods to obtain a random number and, for example, "random number in range" can be used. The "random number in range" is calculated by the following formula, for example. The following formula is expressed by C language for computers.

```
random number in range=minimum value+(int)(rand(
    )*(maximum value−minimum value+1.0)/(1.0+
    RAND_MAX))
```

Note that rand( ) is a rand function that generates pseudo random numbers. For example, the minimum value and the maximum value of the X axis of the sewing coordinate area 21 may be respectively used as the minimum value and the maximum value in the above-described formula. Note that the method to obtain the random number is not limited to this method and another method may be used.

Next, the CPU 61 obtains a Y coordinate where the embroidery pattern 3 is to be arranged, using a random number from a range of the Y axis of the sewing coordinate area 21 (step S9). Note that the method to obtain the random number is the same as that in the case of the X coordinate. Then, the CPU 61 determines whether the embroidery pattern 3 to be arranged at the X and Y coordinates, which are respectively obtained using the random numbers, is contained within the sewing coordinate area 21 (step S10). Depending on the size of the embroidery pattern 3, there is a possibility that a part of the embroidery pattern 3 is located outside the sewing coordinate area 21. Therefore, when the center position of the embroidery pattern 3 is arranged at the X and Y coordinates obtained using the random numbers, the CPU 61 uses the mask data of the embroidery pattern 3 to determine whether the embroidery pattern 3 is contained within the sewing coordinate area 21. In a case where the CPU 61 determines that a part of the embroidery pattern 3 is located outside the sewing coordinate area 21 (no at step S10), the CPU 61 once again obtains the X coordinate and the Y coordinate (step S8, step S9). The CPU 61 repeats step S8 and step S9 until the X and Y coordinates at which the embroidery pattern 3 is contained within the sewing coordinate area 21 are obtained. In a case where the CPU 61 determines that the embroidery pattern 3 to be arranged is contained within the sewing coordinate area 21 (yes at step S10), then the CPU 61 determines whether the embroidery pattern 3 other than the embroidery pattern 3 to be arranged has already been arranged in an area in which the embroidery pattern 3 is to be arranged (step S11). That is, the CPU 61 determines whether the embroidery pattern 3 to be arranged this time overlaps with the embroidery pattern 3 that has already been arranged. Here, for example, mask data is used to determine whether the embroidery patterns 3 overlap with each other.

Figure 5:
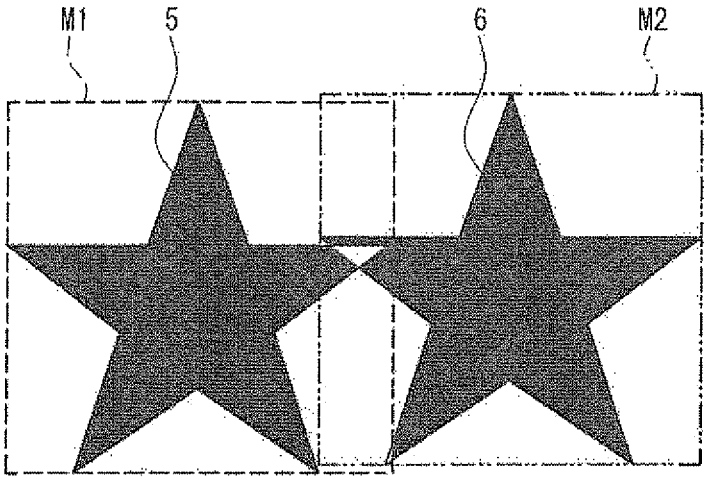
FIG. 5 is a diagram showing a state in which an embroidery pattern 5 and an embroidery pattern 6 partially overlap with each other.

The embroidery pattern overlap determination using mask data will be explained with reference to FIG. 5. As shown in FIG. 5, for example, as an area in which an embroidery pattern 5 with a star shape is to be arranged, mask data M1 is set that is mask data in a case where the embroidery pattern 5 is arranged at the X and Y coordinates obtained using the random numbers, and mask data M2 is set that is mask data for another embroidery pattern 6 that has already been arranged. The CPU 61 determines whether the mask data M1 and the mask data M2 overlap with each other at least partially. Note that the embroidery pattern overlap determination may be made using another method that does not use mask data. For example, coordinate data of needle drop points of the respective patterns may be compared and the overlap determination may be made based on whether any of the coordinate data of the needle drop points match each other.

For example, in a case where the embroidery patterns 3 that are adjacent to each other are sewn on the work cloth in a state in which they overlap with each other at least partially, the finish of the embroidery patterns 3 deteriorates and the appearance deteriorates. To address this, in a case where the other embroidery pattern 3 has already been arranged in the area in which the embroidery pattern 3 is to be arranged based on the obtained X and Y coordinates (yes at step S11), the CPU 61 once more obtains the X coordinate and the Y coordinate (step S8, step S9). The CPU 61 repeats step S8 and step S9 until, for example, the area in which the embroidery pattern 3 is to be arranged is disposed in a position where the embroidery pattern 3 does not overlap with the other embroidery pattern 3 that has already been arranged.

In a case where the CPU 61 determines that the other embroidery pattern 3 does not exist in the area in which the embroidery pattern 3 is to be arranged (no at step S11), the CPU 11 arranges the embroidery pattern 3 at the obtained X and Y coordinates (step S12). Then, the CPU 61 adds 1 to the counter value I stored in the RAM 63, for example (step S13).

Further, the CPU 61 determines whether the counter value I is equal to or more than the number N (step S14). In a case where the counter value I is less than the number N (no at step S14), the CPU 61 returns the processing to step S8. At step S8, the CPU 61 respectively obtains the X coordinate and the Y coordinate for the embroidery pattern 3 that will then be arranged in the sewing coordinate area 21. The CPU 61 repeats the processing from step S8 to step S14 until the counter value I reaches the number N.

In a case where the CPU 61 determines that the counter value I is equal to or more than the number N (yes at step S14), the CPU 61 displays an arrangement result screen (not shown in the drawings) on the LCD 15 (step S15). As shown in FIG. 4, for example, the 43 embroidery patterns 3 are randomly arranged in the sewing coordinate area 21. In this manner, the present embodiment can automatically and easily achieve a beautiful and random arrangement, as compared to a case in which the user manually and randomly arranges the embroidery patterns 3. The CPU 61 stores embroidery data of a whole pattern that is obtained by randomly arranging the embroidery patterns 3 in the RAM 63 or in the external access RAM 68, for example, and ends this processing.

As explained above, the sewing machine 1 of the present embodiment can automatically and randomly arrange the embroidery patterns 3 selected by the user within the sewing coordinate area 21 of the sewing machine 1. The sewing machine 1 is provided with the CPU 61 of the control portion 60. The CPU 61 allows, for example, the user to select an embroidery pattern and further allows the user to input the number N. The CPU 61 randomly arranges, for example, the selected embroidery patterns 3 of the input number N within the sewing coordinate area 21. The CPU 61 obtains the X coordinate and the Y coordinate of each of the embroidery patterns 3 to be arranged within the sewing coordinate area 21, using random numbers, for example. As a result of this, the sewing machine 1 can randomly arrange a plurality of the embroidery patterns 3 within the sewing coordinate area 21.

Further, particularly in the present embodiment, based on the embroidery data, it is determined whether the embroidery patterns 3 that are arranged within the area on which sewing is able to be performed overlap with each other. In a case where it is determined that the overlap occurs, the CPU 61 once more obtains the X coordinate and the Y coordinate of the embroidery pattern 3 using random numbers. Until the overlap of the embroidery patterns 3 is eliminated, the CPU 61 repeatedly obtains the X coordinate and the Y coordinate using random numbers. As a result of this, the embroidery patterns 3 are randomly arranged without overlapping with each other. Therefore, in a case where a plurality of the embroidery patterns 3 are sewn on the work cloth, the embroidery patterns 3 can be sewn beautifully.

The present disclosure is not limited to the above-described embodiment and various modifications are possible. For example, in the above-described embodiment, the sewing machine 1 having the single needle bar is exemplified. However, the present disclosure may be applied to a multi-needle sewing machine having a plurality of (six, for example) needle bars.

Further, in the above-described embodiment, the embroidery patterns 3 selected by the user are randomly arranged, as they are, within the sewing coordinate area 21. However, for example, if the shape and the arrangement etc. of the embroidery patterns 3 are randomly converted and thereafter the embroidery patterns 3 are further arranged randomly within the sewing coordinate area 21, a wide variety of arrangements can be easily achieved for a plurality of the embroidery patterns 3. Given this, a modified example will be explained that performs conversion processing that randomly converts the shape and the arrangement etc. of the embroidery patterns 3.

Figure 6:
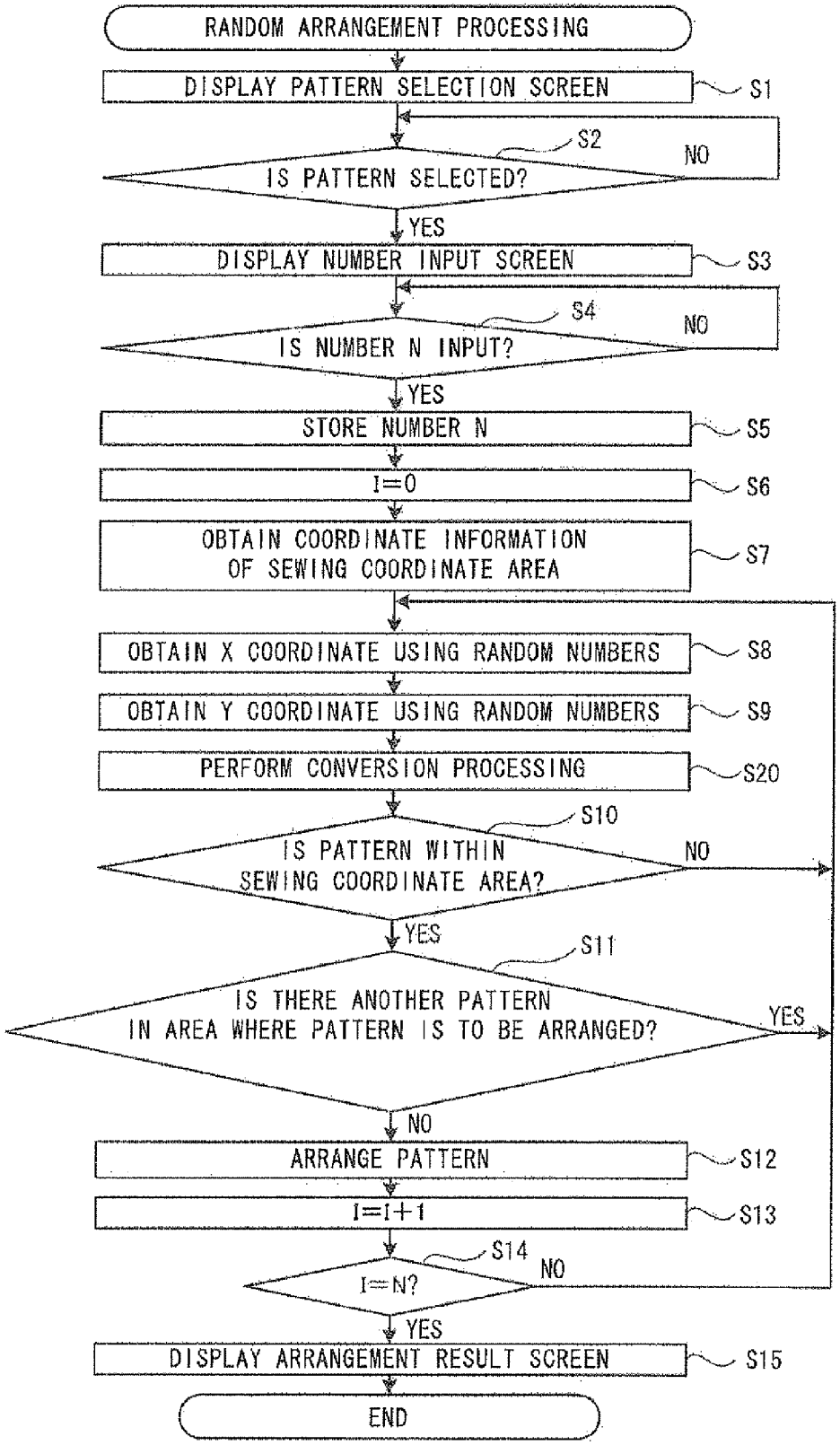
FIG. 6 is a flowchart of a modified example of the random arrangement processing.

The CPU 61 performs random arrangement processing shown in FIG. 6, for example. Although this processing is substantially the same as the random arrangement processing of the above-described embodiment, it differs in that the CPU 61 performs processing at step S20 between step S9 and step S10. After the CPU 61 obtains the X coordinate and the Y coordinate of the embroidery pattern 3 using random numbers (step S8, step S9), the CPU 61 performs the conversion processing (step S20). There are various conversion examples for the conversion processing. Four of the conversion examples will be explained here.

Figure 7:
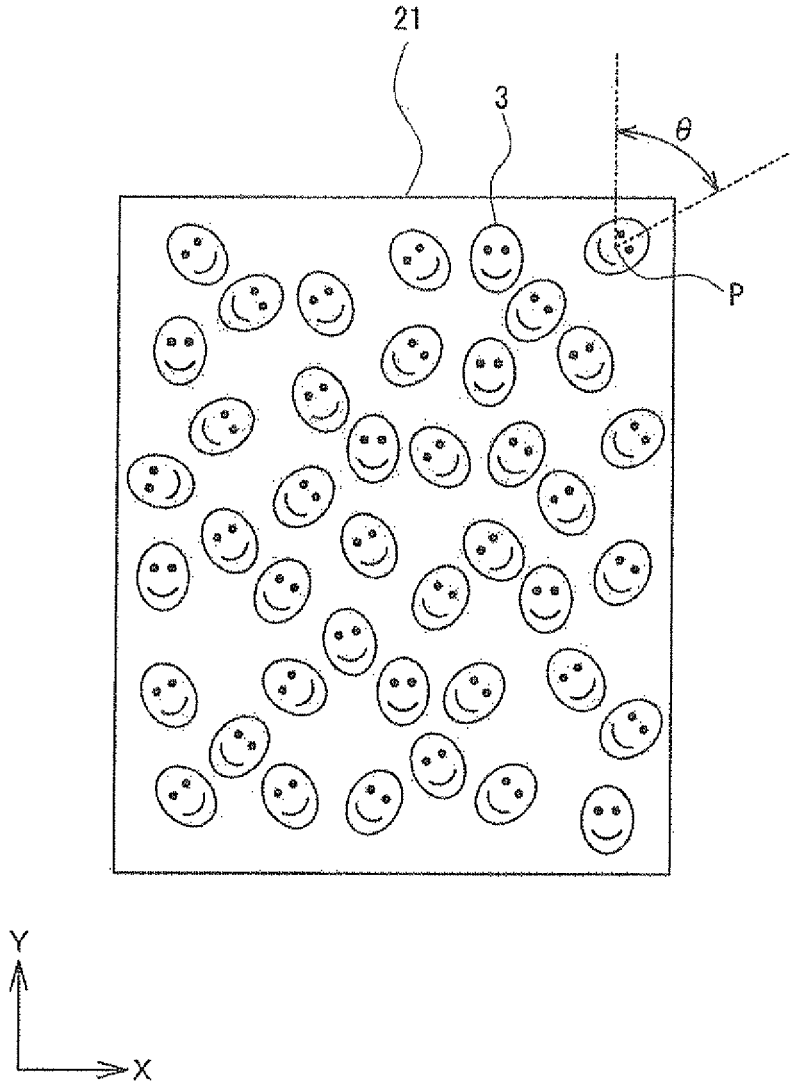
FIG. 7 is a diagram showing a state in which the embroidery patterns 3 are randomly arranged after performing conversion processing in a first conversion example.

A first conversion example will be explained with reference to FIG. 7. The first conversion example is processing in which, for example, the embroidery patterns 3 are randomly rotated within a predetermined angle range. The CPU 61 may obtain an angle θ by which each of the embroidery patterns 3 is rotated within the predetermined angle range, by using a random number, for example. Note that the method to obtain the random number may be the same as that in the above-described embodiment, for example. A rotation center P of the embroidery pattern 3 may be, for example, the center position of the embroidery pattern 3. Further, for example, the rotation center P of the embroidery pattern 3 may be displaced from the center position. FIG. 7 shows a result in which, for example, the 43 embroidery patterns 3 are arranged within the sewing coordinate area 21 after the 43 embroidery patterns 3 are randomly rotated in a range from −90° to +90° taking the Y direction (the upward direction in FIG. 7) as 0°. As described above, in the first conversion example, a wider variety of arrangements can be easily achieved for a plurality of the embroidery patterns 3 in comparison with the above-described embodiment. Further, as the conversion processing is randomly performed, a wide variety of patterns with a sophisticated design can be created. Note that the predetermined angle range is not limited to the range from −90° to +90°. A narrower angle range than the above-described predetermined angle range may be set, or a wider angle range may be set. As a result of this, it is possible to achieve random arrangements of the embroidery patterns 3 with different appearances.

Figure 8:
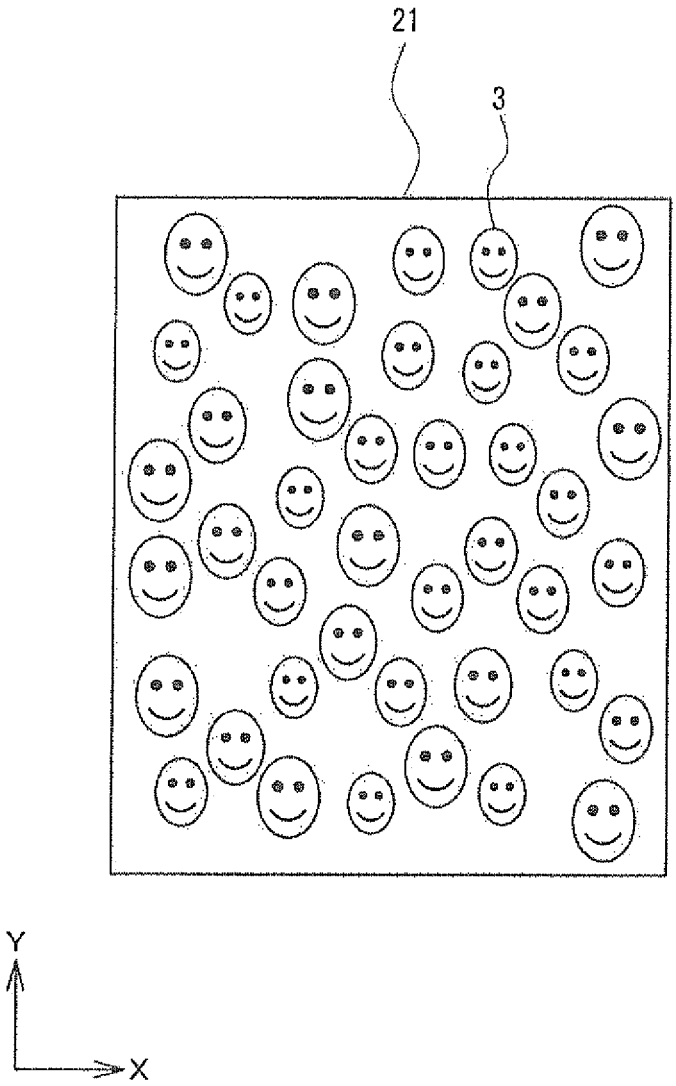
FIG. 8 is a diagram showing a state in which the embroidery patterns 3 are randomly arranged after performing conversion processing in a second conversion example.

A second conversion example will be explained with reference to FIG. 8. The second conversion example is processing in which, for example, the embroidery patterns 3 are randomly enlarged and reduced in a predetermined size range. The CPU 61 may obtain an enlargement/reduction ratio within a predetermined range for each of the embroidery patterns 3, by using a random number, for example. Note that the method to obtain the random number may be the same as that in the above-described embodiment, for example. FIG. 8 shows a result in which, for example, the 43 embroidery patterns 3 are arranged within the sewing coordinate area 21 after the 43 embroidery patterns 3 are randomly enlarged and reduced in a range from 90 to 120%. As described above, in the second conversion example, a wider variety of arrangements can be easily achieved for a plurality of the embroidery patterns 3 in comparison with the above-described embodiment. Further, as the conversion processing is randomly performed, a wide variety of patterns with a sophisticated design can be created. Note that the predetermined range of the enlargement/reduction ratio may be a range that is different from the above-described range.

Figure 9:
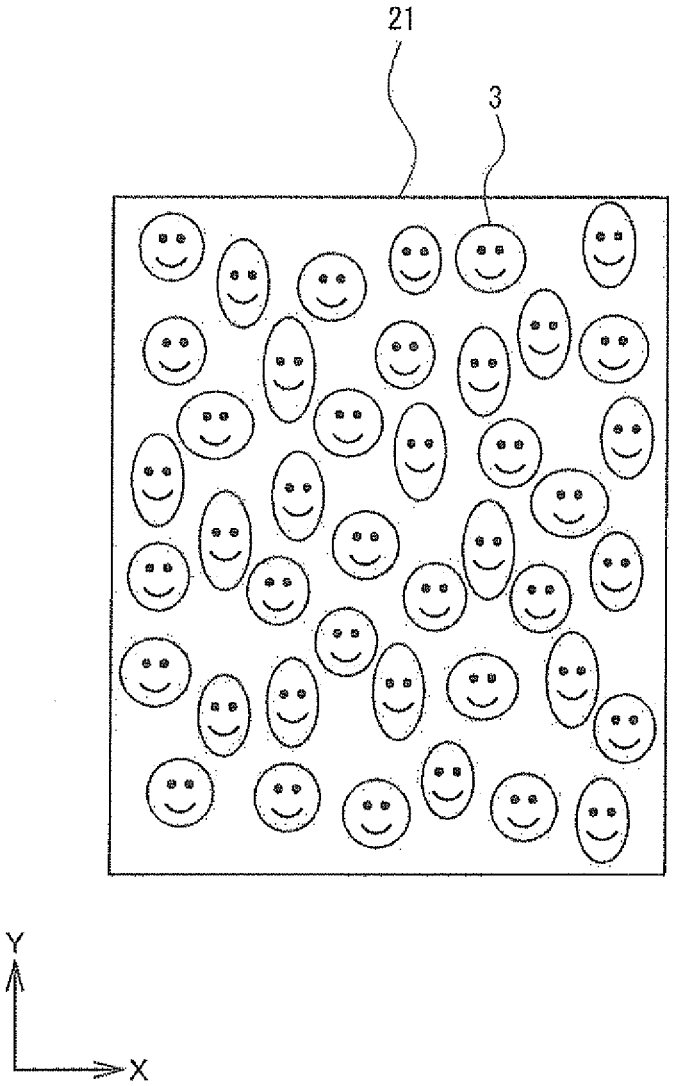
FIG. 9 is a diagram showing a state in which the embroidery patterns 3 are randomly arranged after performing conversion processing in a third conversion example.

A third conversion example will be explained with reference to FIG. 9. The third conversion example is processing in which, for example, the embroidery patterns 3 are each randomly enlarged and reduced in the X axis direction and in the Y axis direction. The CPU 61 may obtain an enlargement/reduction ratio in the X axis direction and an enlargement/reduction ratio in the Y axis direction within a predetermined range, for each of the embroidery patterns 3, by using random numbers, for example. Note that the method to obtain the random numbers may be the same as that in the above-described embodiment, for example. FIG. 9 shows a result in which, for example, the 43 embroidery patterns 3 are arranged within the sewing coordinate area 21 after the 43 embroidery patterns 3 are each randomly enlarged and reduced in a range from 90 to 120% in the X axis direction and in the Y axis direction. As described above, in the third conversion example, a wider variety of arrangements can be easily achieved for a plurality of the embroidery patterns 3 in comparison with the above-described embodiment. Further, as the conversion processing is randomly performed, a wide variety of patterns with a sophisticated design can be created.

Figure 10:
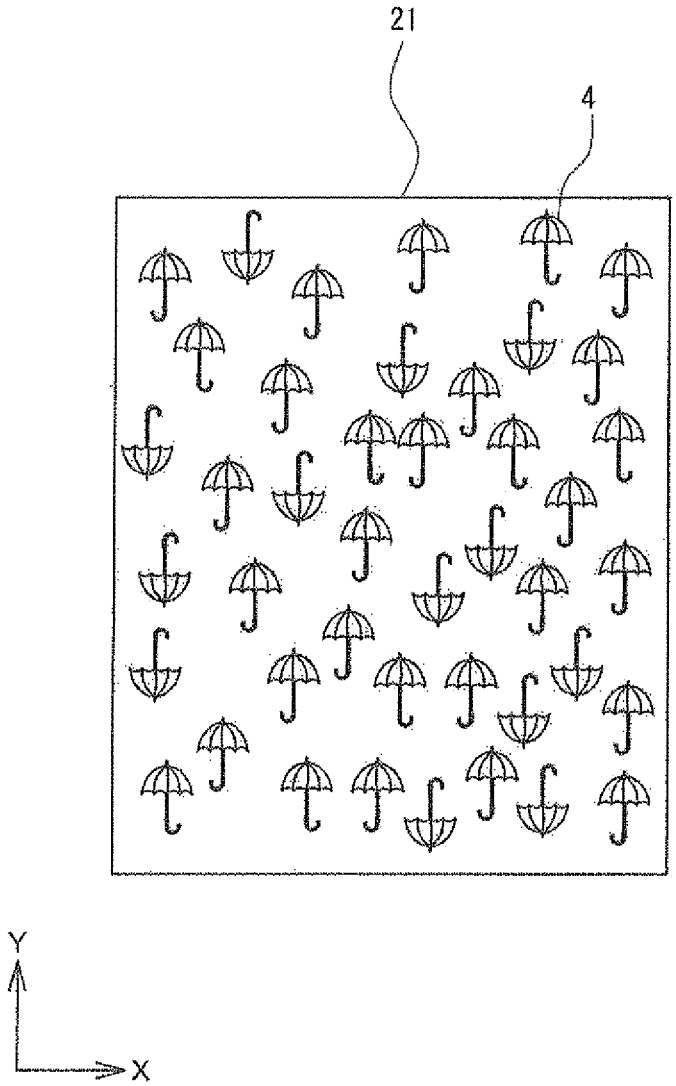
FIG. 10 is a diagram showing a state in which embroidery patterns 4 are randomly arranged after performing conversion processing in a fourth conversion example.

A fourth conversion example will be explained with reference to FIG. 10. The fourth conversion example is processing in which, for example, embroidery patterns 4 are randomly inverted vertically or horizontally. The embroidery pattern 4 is an umbrella mark, for example. The CPU 61 may decide whether each of the embroidery patterns 4 is inverted vertically or horizontally, by using a random number, for example. FIG. 10 shows a result in which, for example, the 43 embroidery patterns 4 are arranged within the sewing coordinate area 21 after the 43 embroidery patterns 4 are randomly inverted vertically or horizontally. As described above, in the fourth conversion example, a wider variety of arrangements can be easily achieved for a plurality of the embroidery patterns 4 in comparison with the above-described embodiment. Further, as the conversion processing is randomly performed, a wide variety of patterns with a sophisticated design can be created. In a case where embroidery patterns are vertically and horizontally asymmetric, the above-described processing is particularly effective because their appearances are significantly different.

Note that, in the above-described conversion examples, the conversion processing is performed on all the embroidery patterns 3 and 4. However, the embroidery patterns 3 and 4 on which the conversion processing is to be performed may be randomly selected.

Figure 11:
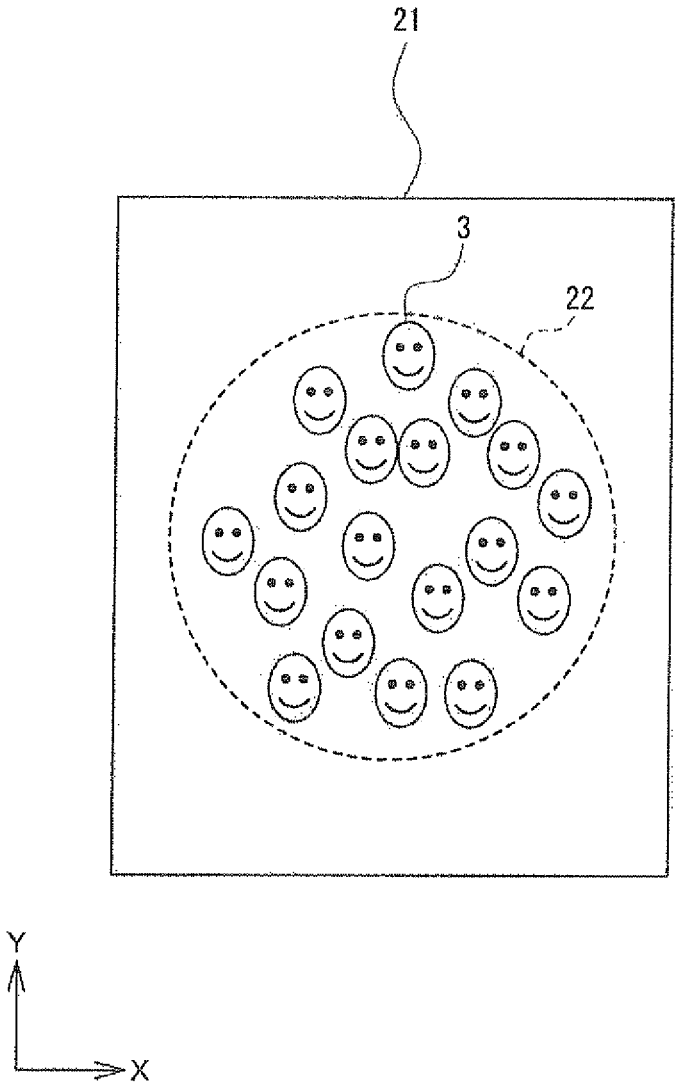
FIG. 11 is a diagram showing a state in which the embroidery patterns 3 are randomly arranged within an area 22 within the sewing coordinate area 21.

Further, in addition to the above-described modified examples, various modifications are possible in the present disclosure. For example, in the above-described embodiment, the plurality of embroidery patterns 3 are randomly arranged, as they are, within the sewing coordinate area 21 of the sewing machine 1. However, for example, as shown in FIG. 11, the user may be allowed to specify, within the sewing coordinate area 21, an area 22 in which the embroidery patterns 3 can be arranged. Although the shape of the area 22 shown in FIG. 11 is a circle, the shape of the area 22 is not limited to a circle. The shape of the area 22 may be freely set by the user, and may be an oval shape, a polygonal shape, a heart shape, a star shape or the like.

Further, in the above-described embodiment, both the X coordinate and the Y coordinate of the embroidery patterns 3 to be arranged within the sewing coordinate area 21 are randomly decided using random numbers. However, coordinate values of at least one of the X coordinate and the Y coordinate may be randomly decided.

Further, in the above-described embodiment, the embroidery frame transport device 33 is a mechanism that moves the embroidery frame 34 based on an orthogonal coordinate system (X, Y). However, the embroidery frame transport device 33 may be a mechanism that moves the embroidery frame 34 based on a polar coordinate system (r, θ), for example.

What is claimed is:

1. An information processing device comprising:

a processor; and a memory configured to store computer-readable instructions that instruct the information processing device to execute steps comprising:

randomly arranging a plurality of embroidery patterns within a coordinate area set in an embroidery frame that is moved in two directions; and performing conversion processing of at least one of rotation, enlargement, reduction, inversion and deformation, for each of the plurality of embroidery patterns to be arranged within the coordinate area, based on a degree of conversion that is randomly decided.

2. The information processing device according to claim 1, wherein randomly arranging the plurality of embroidery patterns within the coordinate area set in the embroidery frame that is moved in the two directions comprises randomly deciding a coordinate value on at least one of coordinate axes of arrangement coordinates of the embroidery patterns to be arranged within the coordinate area that includes the coordinate axes in the two directions.

3. The information processing device according to claim 2, wherein the computer-readable instructions further instruct the information processing device to execute steps comprising: obtaining random numbers; and wherein randomly deciding the coordinate value on at least one of the coordinate axes of the arrangement coordinates of the embroidery patterns to be arranged within the coordinate area comprises deciding the coordinate value based on the obtained random numbers.

4. The information processing device according to claim 1, wherein the computer-readable instructions further instruct the information processing device to execute steps comprising:

determining whether the embroidery pattern which is to be arranged within the coordinate area overlaps with the embroidery pattern which has been arranged within the coordinate area; and rearranging the embroidery pattern which is to be arranged within the coordinate area, in a case where it is determined that the embroidery pattern which is to be arranged within the coordinate area overlaps with the embroidery pattern which has been arranged within the coordinate area.

5. A sewing machine comprising:

a sewing device configured to perform sewing of an embroidery pattern on a work cloth;

an embroidery frame configured to hold the work cloth, and to be moved in two directions;

a processor; and a memory configured to store computer-readable instructions that instruct the sewing machine to execute steps comprising:

randomly arranging a plurality of embroidery patterns within a coordinate area set in the embroidery frame;

performing sewing the embroidery pattern to the work cloth by the sewing device, based on data of the plurality of embroidery patterns; and performing conversion processing of at least one of rotation, enlargement, reduction, inversion and deformation, for each of the plurality of embroidery patterns to be arranged within the coordinate area, based on a degree of conversion that is randomly decided.

6. The sewing machine according to claim 5, wherein randomly arranging the plurality of embroidery patterns within the coordinate area set in the embroidery frame comprises randomly deciding a coordinate value on at least one of coordinate axes of arrangement coordinates of the embroidery patterns to be arranged within the coordinate area that includes the coordinate axes in the two directions.

7. The sewing machine according to claim 6, wherein the computer-readable instructions further instruct the sewing machine to execute steps comprising: obtaining random numbers; and wherein randomly deciding the coordinate value on at least one of the coordinate axes of the arrangement coordinates of the embroidery patterns to be arranged within the coordinate area comprises deciding the coordinate value based on the obtained random numbers.

8. The sewing machine according to claim 5, wherein the computer-readable instructions further instruct the sewing machine to execute steps comprising:

determining whether the embroidery pattern which is to be arranged within the coordinate area overlaps with the embroidery pattern which has been arranged within the coordinate area; and rearranging the embroidery pattern which is to be arranged within the coordinate area, in a case where it is determined that the embroidery pattern which is to be arranged within the coordinate area overlaps with the embroidery pattern which has been arranged within the coordinate area.

9. A non-transitory computer-readable medium storing computer-readable instructions that instruct an information processing device to execute steps comprising:

randomly arranging a plurality of embroidery patterns within a coordinate area set in an embroidery frame that is moved in two directions; and performing conversion processing of at least one of rotation, enlargement, reduction, inversion and deformation, for each of the plurality of embroidery patterns to be arranged within the coordinate area, based on a degree of conversion that is randomly decided.

10. The non-transitory computer-readable medium according to claim 9, wherein randomly arranging the plurality of embroidery patterns within the coordinate area set in an embroidery frame that is moved in the two directions comprises randomly deciding the coordinate value on at least one of coordinate axes of arrangement coordinates of the embroidery patterns to be arranged within the coordinate area that includes the coordinate axes in the two directions.

11. The non-transitory computer-readable medium according to claim 10, wherein the computer-readable instructions further instruct the information processing device to execute steps comprising: obtaining random numbers; and wherein randomly deciding the coordinate value on at least one of the coordinate axes of the arrangement coordinates of the embroidery patterns to be arranged within the coordinate area comprises deciding the coordinate value based on the obtained random numbers.

12. The non-transitory computer-readable readable medium according to claim 9, wherein the computer-readable instructions further instruct the information processing device to execute steps comprising:

determining whether the embroidery pattern which is to be arranged within the coordinate area overlaps with the embroidery pattern which has been arranged within the coordinate area; and rearranging the embroidery pattern which is to be arranged within the coordinate area, in a case where it is determined that the embroidery pattern which is to be arranged within the coordinate area overlaps with the embroidery pattern which has been arranged within the coordinate area.

* * * * *